US008639150B2

(12) United States Patent
Ohmura et al.

(10) Patent No.: US 8,639,150 B2
(45) Date of Patent: Jan. 28, 2014

(54) DEVELOPMENT DEVICE AND IMAGE FORMING APPARATUS

(75) Inventors: Tomoya Ohmura, Kanagawa (JP); Yasuo Takuma, Kanagawa (JP); Junichi Matsumoto, Kanagawa (JP); Hiroshi Kikuchi, Kanagawa (JP); Natsumi Katoh, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 224 days.

(21) Appl. No.: 13/010,264

(22) Filed: Jan. 20, 2011

(65) Prior Publication Data

US 2011/0182610 A1 Jul. 28, 2011

(30) Foreign Application Priority Data

Jan. 25, 2010 (JP) ..... 2010-013086

(51) Int. Cl.
*G03G 21/20* (2006.01)

(52) U.S. Cl.
USPC ..... 399/94; 399/111; 399/119; 399/237

(58) Field of Classification Search
USPC ..... 399/111, 119, 94, 237, 92
See application file for complete search history.

(56) References Cited

U.S. PATENT DOCUMENTS

| | | | | |
|---|---|---|---|---|
| 6,785,490 | B2 * | 8/2004 | Tsukamoto et al. | 399/94 |
| 7,245,853 | B2 | 7/2007 | Muramatsu et al. | |
| 7,346,286 | B2 | 3/2008 | Matsumoto et al. | |
| 7,356,288 | B2 | 4/2008 | Iwata et al. | |
| 7,444,107 | B2 | 10/2008 | Takeuchi et al. | |
| 7,636,536 | B2 | 12/2009 | Iwata et al. | |
| 7,729,642 | B2 | 6/2010 | Matsumoto et al. | |
| 7,783,233 | B2 | 8/2010 | Iwata et al. | |
| 7,792,472 | B2 | 9/2010 | Ichikawa et al. | |
| 7,835,653 | B2 | 11/2010 | Katoh et al. | |
| 2001/0026704 | A1 * | 10/2001 | Nukada | 399/94 |
| 2005/0180772 | A1 * | 8/2005 | Dergham et al. | 399/92 |
| 2007/0154242 | A1 | 7/2007 | Matsumoto et al. | |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |

(Continued)

FOREIGN PATENT DOCUMENTS

| | | |
|---|---|---|
| JP | 05-322146 | 12/1993 |
| JP | 2003-302820 | 10/2003 |

(Continued)

OTHER PUBLICATIONS

Office Action dated Aug. 6, 2013, issued in Japanese Patent Application No. 2010-013086.

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A development device includes a developing section to visualize a latent image formed on a latent image carrier with developer including toner and carrier. The development device has a developer supply opening and a developer collection opening, a circulation unit to transport the developer collected from the developer collection opening of the developing section to the developer supply opening of the developing section and including a developer container to store the developer collected from the developing section disposed upstream from the development section in a direction in which the developer is circulated, and a developer cooler to cool the developer contained in the developer container.

18 Claims, 10 Drawing Sheets

(56) References Cited

U.S. PATENT DOCUMENTS

| | | | |
|---|---|---|---|
| 2008/0298866 | A1 | 12/2008 | Matsumoto et al. |
| 2009/0028611 | A1 | 1/2009 | Matsumoto et al. |
| 2009/0123174 | A1 | 5/2009 | Iwata et al. |
| 2009/0317106 | A1 | 12/2009 | Ohmura et al. |
| 2010/0061774 | A1 | 3/2010 | Iwata et al. |
| 2010/0124443 | A1 | 5/2010 | Ohmura et al. |
| 2010/0143000 | A1 | 6/2010 | Matsue et al. |

FOREIGN PATENT DOCUMENTS

| | | |
|---|---|---|
| JP | 2006-084874 | 3/2006 |
| JP | 2007-226148 | 9/2007 |
| JP | 2008-064901 | 3/2008 |
| JP | 2008-300161 | 12/2008 |
| JP | 2009-116198 | 5/2009 |
| JP | 2009-198731 | 9/2009 |

* cited by examiner

DEVELOPMENT DEVICE AND IMAGE FORMING APPARATUS

CROSS-REFERENCE TO RELATED APPLICATIONS

This patent specification claims priority from Japanese Patent Application No. 2010-013086, filed on Jan. 25, 2010, in the Japan Patent Office, the entire contents of which are hereby incorporated by reference herein.

BACKGROUND OF THE INVENTION

1. Field of the Invention

The present invention relates to a development device and an image forming apparatus such as a copier, printer, facsimile machine, plotter, or multi-function device.

2. Description of the Background Art

Electrophotographic image forming apparatuses such as copiers, printers, facsimile machines, plotters, multi-function devices, or the like typically include a development device and a transfer unit. The development device develops a latent image formed on a photoreceptor serving as a latent image carrying member into a visible toner image. The transfer unit transfers the toner image from the photoreceptor onto a recording medium (e.g., transfer sheet) to form an image on the recording medium.

Much-sought-after features of such apparatuses include compactness, high-quality imaging, and speed. In an image forming apparatus proposed in JP-2009-116198-A, by positioning a developer container separately from a developing section to visualize a latent image formed a surface of the image carrier and circulating the developer, the developing section can be made compact. In addition, by providing the developer container with an efficient agitator, the ability to mix and disperse the supplied toner into the developer can be improved. Thus, high-quality images can be attained even when the printing speed is increased. In this example, because the developing section is compact, this technique can be used for a development device including multiple stations (i.e., more colors) to increase the image quality.

A possible drawback of the more-compact development device described above is that, because the development device can be made more compact, the surface area of the actual developing section of the device shrinks, degrading the ability to disperse heat efficiently.

Heat generation is intrinsic to image formation. In electrophotographic image forming apparatuses, a toner image is formed on a recording medium through a charging process, an exposure process, a development process, a transfer process, and a fixing process. While these image forming processes are performed, for example, a motor, a lighting source, and a fixing device all produce heat. More specifically, in the developing section, heat is generated by a difference in linear velocity between a photoreceptor and a development roller, an eddy current generated by rotating the development sleeve around the magnet at high speed, and friction between the developer and a doctor blade while the accumulated developer is smoothed by the doctor blade. Thus, the development section itself generates heat.

Moreover, with this configuration, the temperature in the image forming apparatus is increased when printing is continuously performed, affecting the properties of the toner in the development device. As a result, operating problems, such as a decrease in the fluidity of the developer and toner coagulation, are apt to occur, which may cause defective image formation.

In the development device described above, in order to inhibit the temperature from increasing, external air is sucked into the device and circulated by a fan. However, in a configuration in which the developer container is provided separately from the developing section, because the developing section is compact, that is, the developing section has a small outer surface area, the cooling efficiency is limited. As a result, the temperature increase of the developer of the development device during driving may be greater than that of a known development device in which the developer container is not provided separately from the developing section. In addition, in order to circulate the external air in the development device with the fan, providing a circulation path is required, which hinders the ability to make the configuration compact.

An approach has been proposed in which, in order to cool the developer, the developer is conveyed by air, that is, external air whose temperature is lower than that of the image forming apparatus, so that the developer can be cooled. However, in this example in which the developer is cooled during transport, the cooling time is normally insufficient, and therefore the transport path is required to be lengthened. If the transport path is lengthened, then when the developer is conveyed by air, the decrease of the transport efficiency is caused, and thus the configuration is impractical. Therefore, this approach cannot solve the problem that the developer is not cooled sufficiently.

In view of the foregoing, there is market demand for a development device in which the developer container is provided separately from the developing section and which is capable of cooling the developer effectively and efficiently without lengthening the transport path.

SUMMARY OF THE INVENTION

In view of the foregoing, one illustrative embodiment of the present invention provides a development device that includes a developing section, a circulation unit, a developer container, and a developer cooler. The developing section visualizes a latent image formed on a latent image carrier with developer including toner and carrier, having a developer supply opening and a developer collection opening. The circulation unit transports the developer collected from the developer collection opening of the developing section to the developer supply opening of the developing section. The developer container stores the developer collected from the developing section, disposed upstream from the development section in a direction in which the developer is circulated in the circulation unit. The developer cooler cools the developer contained in the developer container.

Another illustrative embodiment of the present invention provides an image forming apparatus that includes a latent image carrier on which a latent image is formed, and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
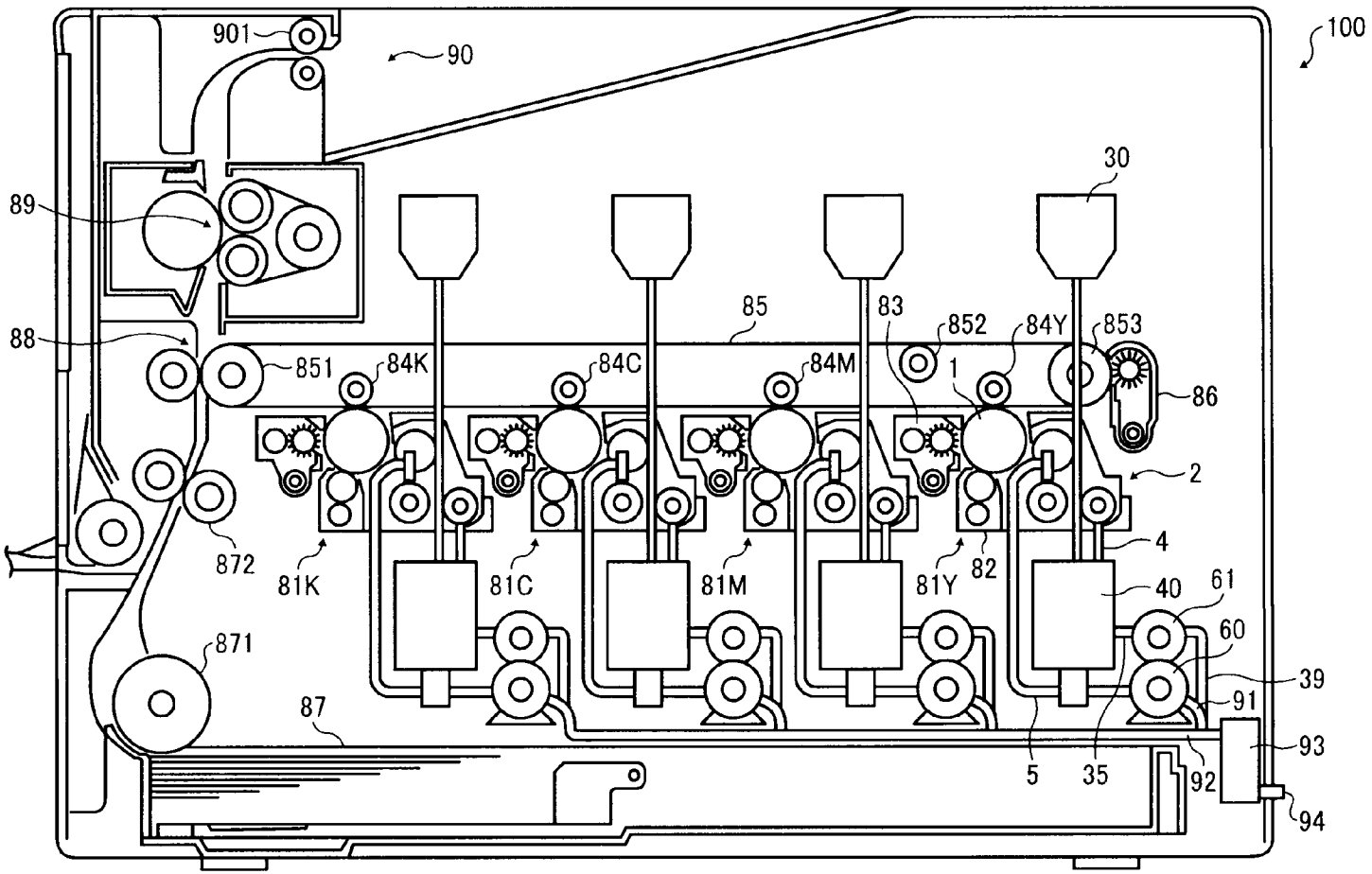
FIG. 1 is a schematic diagram illustrating a color image forming apparatus including a development system according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIGS. 1 through 5, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

First Embodiment

FIG. 1 is a schematic diagram illustrating an entire configuration of a color image forming apparatus 100 including a development system of the present embodiment. A configuration and operation of the present embodiment is described below.

The image forming apparatus 100 in FIG. 1 includes four image forming units 81Y, 81M, 81C, and 81K for respectively forming yellow, magenta, cyan, and black, (hereinafter also simply "Y, M, C, and K") single-color toner images disposed facing a lower surface of an intermediate transfer belt 85.

It is to be noted that, in this specification, reference character suffixes Y, M, C, and K attached to an identical reference numeral indicate only that components indicated thereby are used for forming different single-color images, respectively, and hereinafter may be omitted when color discrimination is not necessary. Using the image forming unit 81Y as an example, the configurations of the image forming units 81M, 81C, and 81K are described below.

As shown in FIG. 1, the image forming unit 81Y includes a photoreceptor 1, serving as a latent image carrier, a charger 82, a developing section 2, and a cleaning device 83.

In the image forming unit 81Y, the photoreceptor 1 is rotated by a driving mechanism, not shown, and, a surface of the photoreceptor 1 is uniformly charged in a portion facing the charger 82. When the surface of the photoreceptor 1 reaches a portion receiving a laser beam emitted from a light writing unit, not shown, the laser beam scans the surface of the photoreceptor 1, thus forming a latent image on the portion receiving the laser beam in accordance with image formation. Then, the latent image formed on the surface of the photoreceptor 1 reaches a portion facing the developing section 2, and the latent image thereon is developed into a toner image with the toner included in developer supplied from the developing section 2.

Inside the intermediate transfer belt 85, four primary transfer members 84, a secondary transfer support roller 851, a belt tension roller 852, a belt-cleaning support roller 853 are provided. A belt-cleaning device 86 that cleans the intermediate transfer belt 85 is disposed facing the intermediate transfer belt 85 and the belt-cleaning support roller 853.

When the respective surfaces of the photoreceptors 1Y, 1M 1C, and 1K that carry the toner images reach the portions facing the intermediate transfer belt 85 and primary transfer members 84Y, 84M, 84C, and 64K, toner images formed on the respective photoreceptors 1Y, 1M, 1C, and 1K are primarily transferred from the photoreceptors 1Y, 1M, 1C, and 1K and superimposed one on another on the surface of the intermediate transfer belt 85. Thus, a multicolor (four-color) image is formed on the intermediate transfer belt 85.

After the primary transfer process, the toner image formed on the surface of the photoreceptor 1 reaches a portion facing the cleaning device 83, where un-transferred toner that remains on the surface of the photoreceptor 1 is collected by the cleaning device 83.

A secondary transfer member 88 is disposed facing and pressing against the secondary transfer support roller 851 in the intermediate transfer belt 85, forming a secondary transfer nip therebetween. When the four-color toner image formed on the surface of the intermediate transfer belt 85 reaches the secondary transfer nip, the four-color toner image is transferred onto a transfer sheet P, at one time.

Along with these processes, the transfer sheet P is fed one-by-one by a feed roller 871 from a feeding cassette 87 that is disposed in a lower portion of the image forming apparatus 100 and contains multiple transfer sheets P.

Then, the transfer sheet P thus fed is stopped by a pair of registration rollers 872, and then skews of the transfer sheet P is corrected, after which the pair of the registration rollers 872 transports the transfer sheet P toward the second transfer nip at an appropriate timing. Thus, the desired multicolor toner image is transferred onto the transfer sheet P at the second transfer nip.

The transfer-sheet P onto which the multicolor image is transferred at the second transfer nip is transported to a fixing device 89 positioned above the secondary transfer member 88 in FIG. 1, where the four-color toner image thus transferred is fixed on the surface of the transfer sheet P with heat and pressure.

After that, the transfer sheets P are discharged toward a discharge sheet portion 90 located on an upper portion of the image forming apparatus 100 via a pair of discharging sheet rollers 901 and are stacked on the discharge sheet portion 90. Thus, a series of the image forming process completes.

Hereinafter, a system including all items to perform the development process including the developing section 2 and a developer container unit 40 formed by a developer container 40*a* and a coolant transport path 37 is called as a development system 400. The development system 400 serves as a development device. As shown in FIG. 1, each of the development systems 400 further includes a toner hopper 30, a developer-supply tube 4, a developer-collection tube 5, an air-conveying pump 60, an air supply pipe 33, an air-refrigerating pump 61, and a coolant supply pipe 35.

The image forming apparatus 100 further includes a coolant induction pipe 39, an air suction pipe 91, a fresh-air suction pipe 92, a dehumidifier 93, and a fresh air intake 94. The fresh air is sucked to the image forming apparatus 100 by the fresh air intake 94 and then is dehumidified in the dehumidifier 93. Because the coolant induction pipe 39 and the air suction pipe 91 are bifurcated from the fresh-air suction pipe 92, the dehumidified fresh air is transported to the air-conveying pump 60 through the fresh-air suction pipe 92 and the air suction pipe 91 and is transported to the air-refrigerating pump 61 through the fresh-air suction pipe 92 and the coolant induction pipe 39.

Herein, although a developer in which toner and carrier is mixed is agitated in only a development unit in a comparative example, in the present embodiment, the developer container 40*a* in which the developer is agitated is provided separately from the developing section 2 that visualizes (develops) a latent image on the photoreceptor 1 into a visible image. Therefore, the developer is thoroughly agitated in the developer container 40*a* as compared with the comparative example, and thus, toner concentration and charging amount of the developer can be stably adjusted. Accordingly, stable image formation can be performed without increasing the developing section size.

Figure 2:
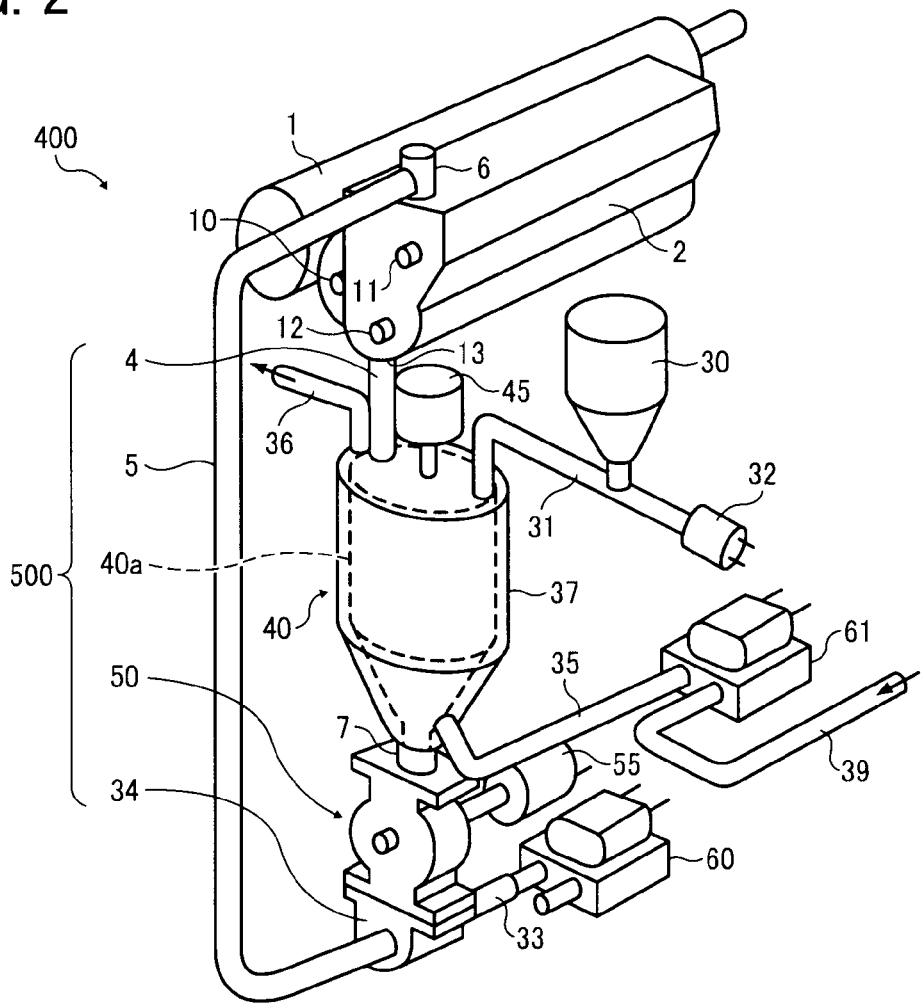
FIG. 2 illustrates the development system incorporated in the image forming apparatus shown in FIG. 1.

Next, a configuration of the development system 400 is described below. FIG. 2 is a perspective view illustrating the development system 400 according to the present embodiment. As shown in FIG. 2, the development system 400 includes the developing section 2, a toner supply unit, and the air pumps 60 and 61, and a circulation unit 500 including the developer container 40*a*, a rotary feeder 50, a developer-air mixing section 34, and a circulation route formed with the developer-collection tube 4 and the developer-supply tube 5.

In FIG. 2, the developing section 2 is capable of containing the developer that develops an electrostatic latent image on the photoreceptor 1. The developer container 40*a* that is located separately from the developing section 2 agitates and mixes the developer collected from the developing section 2 with fresh toner whose amount corresponds to the amount of the consumed toner. The rotary feeder 50 transports the developer discharged from the developer container 40*a* after being agitated therein. The air-conveying pump 60 functions as a developer circulation driving source to convey the developer to the developing section 2 with compressed air.

The circulation unit 500 conveys the developer collected from a developer collection opening 13 of the developing section 2 to a developer supply opening 6 in the developing section 2 through the developer collection tube 4, the developer container 40*a*, the rotary feeder 50, the developer-air mixing section 34, and the developer-supply tube 5. The circulation route is formed with the developer-collection tube 4 and the developer-supply tube 5, and both tubes connect the developing section 2 and the developer container 40*a*. In the configuration shown in FIG. 2, the developer-collection tube 4 directly connects a lower portion of the developing section 2 with an upper portion of the developer container 40*a*. In addition, the lower portion of the developer container 40*a* and the upper portion of the developing section 2 are connected by the developer-supply tube 5 through the rotary feeder 50 that is located beneath the developer container 40*a* and a developer-air mixing section 34 that is located beneath the rotary feeder 50. Thus, the circulation route is formed, and devices provided therealong function as the circulation unit. Further, the developer-collection tube 4 is connected to a downstream side of a shaft 12 of a second screw conveyer 22 (shown in FIG. 3) in a direction in which the developer is conveyed (hereinafter "developer transport direction").

The developer container 40*a* has an upper portion that is cylindrical and a funnel-shaped lower portion. Inside the developer container 40*a*, an agitator 43 (described in detail later) is provided. An agitator-driving motor 45 that drives the agitator 43 is provided above the developer container 40*a*.

The developer agitated in the developer container 40*a* is supplied to the rotary feeder 50 that can adjust the amount of developer supplied by rotating a rotary impeller 52 located therein (shown in FIG. 4) by driving an impeller-driving motor 55. The developer whose amount is thus adjusted is supplied to the developing section 2 by compressed air generated by the air-conveying pump 60 through the developer-air mixing section 34.

The toner supply unit includes the toner hopper 30, a toner-supply path (tube) 31 connecting the toner hopper 30 to the developer container 40*a*, and a toner supply motor 32 that drives a conveying member, not shown, such as a screw auger in the toner-supply path 31. Thus, the fresh toner in the toner hopper 30 is supplied to the developer container 40*a* through the toner-supply path 31 by rotating the screw augur driven by the toner supply motor 32.

As shown in FIG. 2, the air-refrigerating pump 61 is connected to the coolant transport path 37 in the developer container unit 40 through the coolant supply pipe 35, and takes in an external air through the coolant induction pipe 39, both of which are described in further detail later.

The developing section 2 includes a development roller 20 and screw conveyers 21 and 22, end portions of the shafts of which are shown as 10, 11, and 12 in FIG. 2.

Figure 3:
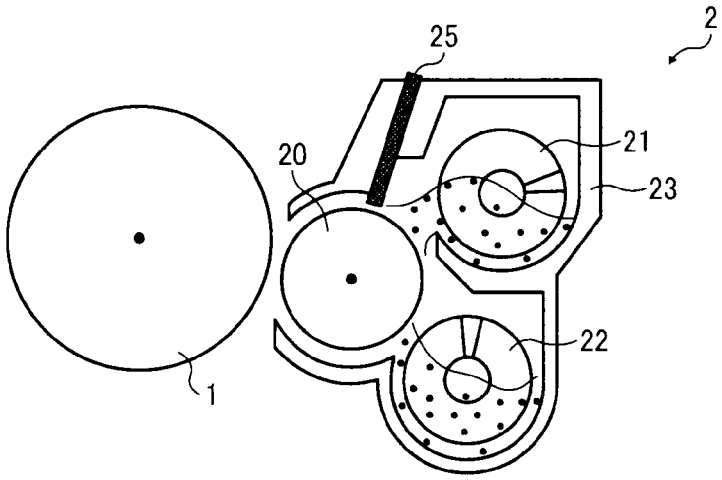
FIG. 3 is a schematic diagram illustrating a developing section of the development system shown in FIG. 2.

The interior structure of the developing section 2 is shown in schematic cross-section in FIG. 3.

As shown in FIG. 3, the developing section 2 housed in a casing 23 includes a doctor blade 25 in addition to the development roller 20, the screw conveyors 21 and 22. The development roller 20 disposed facing the photoreceptor 1 includes an internal magnet. The developer magnetically attracted by the development roller 20 is smoothed by the doctor blade 25 to a uniform thickness. When the surface of the photoreceptor 1 contacts the developer where the photoreceptor 1 faces the development roller 20 (hereinafter "development region"), an electrostatic latent image on the photoreceptor 1 is developed with the toner into the toner image thereon.

In the developing section 2, the first screw conveyer 21 moves the developer in an upper chamber of the casing 23 from the front side to the back side of the sheet of paper on which FIG. 3 is drawn, and the second screw conveyer 22 moves the developer in a lower chamber of the casing 23 from back side to front side of the sheet of paper on which FIG. 3 is drawn.

A developer discharge opening through which the collected developer in the developing section 2 flows to the developer-collection tube 4 is formed in a front side of the second screw conveyor 22. The developer that passes unused through the development region is discharged and conveyed to the developer container 40*a* via the developer outlet (not shown) and the developer-collection tube 4 (shown in FIG. 2) located on an extreme downstream portion of the second transport screw conveyor 22 in the developer transport direction.

Figure 4:
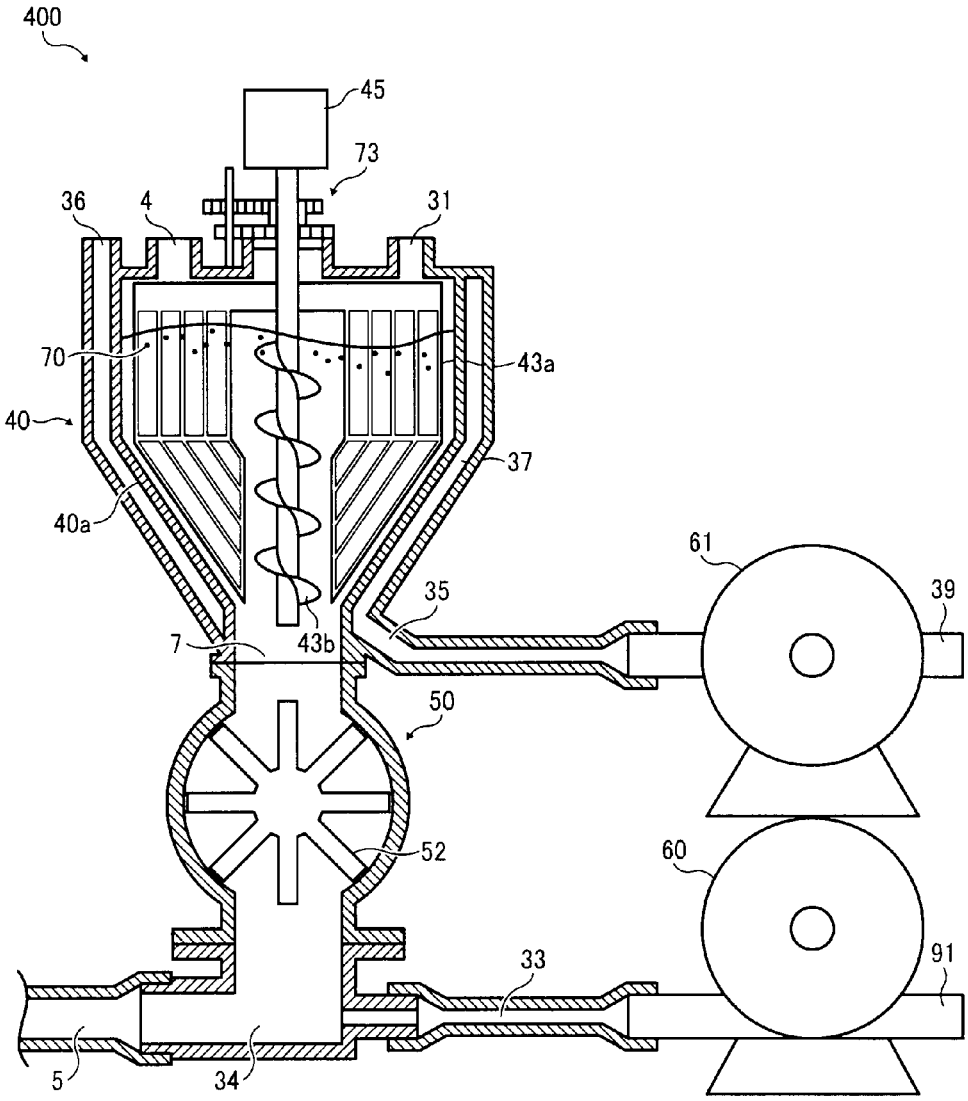
FIG. 4 is a schematic cross-sectional diagram illustrating a developer container unit and surrounding structures of the development system shown in FIG. 2.

FIG. 4 illustrates an internal structure of the developer container unit 40 and the rotary feeder 50, and the surrounding structures.

As shown in FIG. 4, the developer container 40*a* is shaped like an upright cylinder, a lower end of which forms a funnel, that is, a tapered portion of downwardly decreasing diameter. A developer inlet connecting to the toner-supply tube 4 is formed on a top face of the developer container 40*a*, and a developer outlet 7 that is located in the lowest portion of the developer container 40*a* where the developer container 40*a* is narrowest and is a bottom portion thereof is connected to the rotary feeder 50.

The conveyance of the developer from the developer inlet of a developer agitation portion (upper portion) in the developer container 40*a* to the developer outlet 7 is by gravity, and agitator 43 mixes and agitates the supplied toner and developer while the developer drops in the developer container 40*a*.

Since a predetermined amount of developer 70 is always located in the developer agitation portion as a buffer, the un-mixed developer in the developer container 40*a* is not directly discharged to the rotary feeder 50 via the developer outlet 7.

As described above, the spiral auger (not shown) is provided in the toner transport path 31. The toner supply motor 32 (see FIG. 2), serving as a driving source, is connected to another end of the toner supply path 31 and drives the spiral auger to rotate. Thus, the toner in the toner hopper 30 is supplied to the developer agitation portion of the developer container 40*a*, and the supplied toner is rapidly agitated and mixed with the developer by the agitator 43 driven by the agitator-driving motor 45. The agitator 43 and the agitator-driving motor 45 together function as an agitation device.

As shown in FIG. 4, the developer container unit 40 includes the developer container 40*a* that is an inner casing for containing the developer, the agitator 43, and the coolant transport path 37 functioning as a developer cooler (described in detail later.) The agitator 43 includes an outer agitator 43*a* formed of multiple linear members that agitate an outer radial portion of the developer container 40*a* and an inner agitator 43*b* formed of an agitation screw that agitates a center portion of the developer container 40*a*. The agitation screw 43*b* is connected to the agitator-driving motor 45, and the screw is rotated by the agitator driving motor 45 via decelerating gears 73.

The outer agitator 43*a* is formed of multiple linear members that are symmetrical about a centerline, moves the developer by rotating, and mixes the developer with the supplied toner. More specifically, because the part of developer is moved by rotating the multiple linear members 43*a* and the other remaining developer passes through the gap between the adjacent linear members 43*a*, agitation and mixing of the developer are promoted.

Additionally, because the linear members 43*a* include gaps functioning as escape portions, excessive contact load on the developer from the agitator 43*a* can be prevented, and as a result, the agitator 43*a* can rotate at high speed and the action of agitation and mixing can be enhanced.

In addition, since the agitator 43*a* rotates the developer, frictional electrification between the toner and carrier is enhanced, and therefore the toner can be uniformly charged.

As described above, by using the linear member as the agitator 43*a*, even when a relatively large amount of the toner is supplied in the toner container 40*a*, dispersal and mixing of the toner into (with) developer and increasing the charging amount can be rapidly executed. In addition, because the physical damage on the developer can be lessened, the charging amount of the toner can be stabilized over time without degrading the developer. Thus, stable image quality can be attained without contamination of the white sheet and the toner scattering.

Next, a feature of the development system 400 according to the present embodiment is described below with reference to FIG. 4.

In the present embodiment, the developer cooler is formed of a coolant transport path 37 and the air-refrigerating pump 61 (see FIG. 2). The coolant transport path 37 guides coolant while the coolant contacts on the outer surface of the developer container 40*a*. As shown in FIG. 2, external air (fresh air) is used as the coolant, and the air-refrigerating pump 61, serving as a coolant supply device, takes in the external air through the coolant induction pipe 39. Then, the external air in the air-refrigerating pump 61 is transported to the coolant transport path 37 positioned outside the outer surface of the developer container 40*a* through the coolant supply pipe 35.

While the coolant (external air) is moved through the coolant transport path 37 shown in FIG. 4, the coolant (external air) absorbs the heat from the developer through the developer container 40*a* (casing), and then the coolant, the temperature of which is increased by thus absorbing heat from the developer, is discharged outside through a coolant collection pipe 36 that is connected to the coolant transport path 37. At this time, because the air (coolant) discharged from the coolant transport path 37 in the developer container unit 40 is rapidly discharged outside of the image forming apparatus 100 using a discharge duct and a fan (not shown), an increase in the temperature in the vicinity of the developer container 40*a* can be prevented.

In addition, it is preferable that at least a part of the developer container (casing) 40*a* in the developer container unit 40 be formed of a high heat-conductivity material as a heat sink to transfer the heat from the developer to the coolant in the coolant transport path 37. There are certain advantages to such a configuration, as described in detail below.

Generally, casings of developer containers are generally formed of a resin whose heat-conductivity is low. However, if the heat-conductivity of the casing (developer container) 40*a* of the developer container unit 40 is low, the heat of the developer in the developer container 40*a* cannot be rapidly transferred to the coolant transport path 37. In this case, it takes a relatively long time for cooling and the developer is discharged from the developer container 40*a* without releasing heat to the coolant, and therefore, cooling efficiency may be poor.

By contrast, in the present embodiment, because the developer container (casing) 40*a* of the developer container unit 40 is at least partially formed of the heat sink that is formed of the high heat-conductivity material, the heat of the developer in the developer container 40*a* can be rapidly absorbed and released to the coolant transport path 37. Thus, the developer collected from the developing section 2 can be constantly cooled rapidly, and developer thus cooled sufficiently is circulated to the developing section 2. Therefore, temperature increase in the developing section 2 can be prevented.

Although it is preferable that the heat sink be formed of a material whose heat-conductivity is high, such as aluminum, copper, etc, the material of the heat sink is not limited to theses materials as long as the material has high heat-conductivity.

Thus, by using the high heat-conductivity material for the casing (developer container 40*a*), cooling efficiency can be enhanced in the development system 400. This feature can be also adapted for other embodiments described below.

Figure 5:
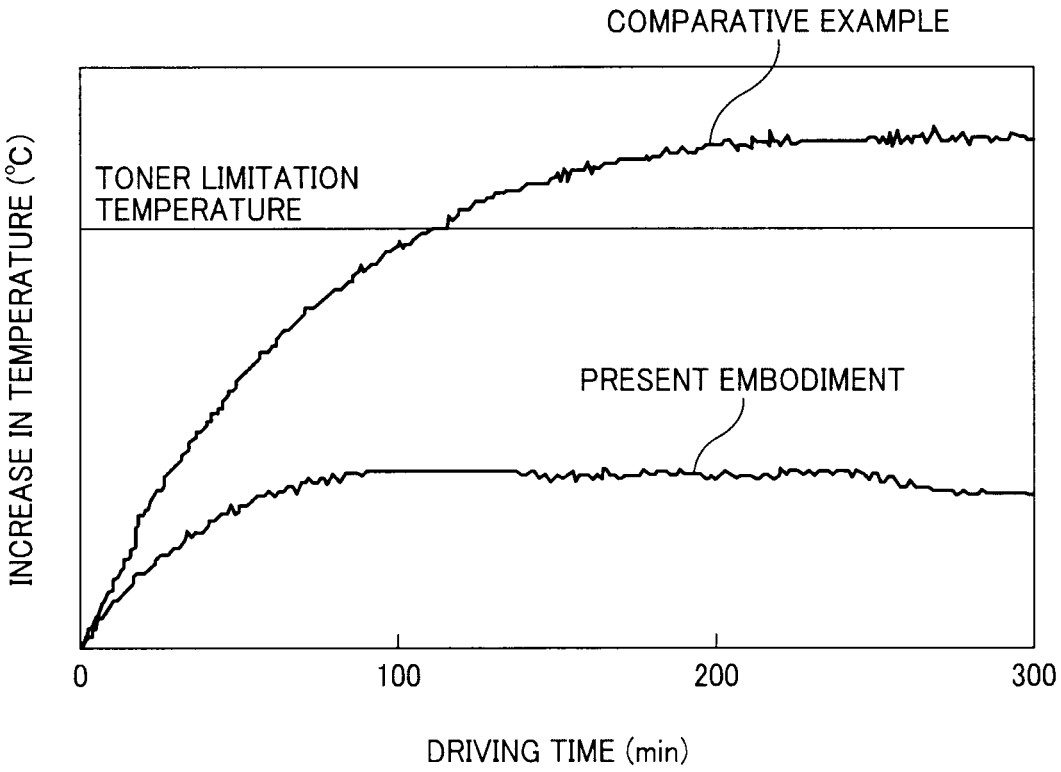
FIG. 5 is a graph that compares temperature increase of the developer in the development system shown in FIG. 4 and that in a development system according to a comparative example that does not include a developer container.

FIG. 5 is a graph that compares the temperature increase of the developer in the development system 400 shown in FIG. 4 and that in a development system (not shown) according to a comparative example that does not include a developer container. The total amount of developer in both development systems is similar (comparative example configuration: development system shown in FIG. 4=11:12).

In this experiment, the increase in temperature of the developer in the development system 400 is only 35% of the increase in temperature of the developer in the comparative example, which shows that cooling efficiency in the development system 400 is greater than that of the comparative example.

In addition, under conditions in which the printing driving time is long, the developer in the development system according to the comparative example exceeds a toner limitation temperature, which is a temperature at which the amount of the coagulated toner is significantly increased.

By contrast, the developer in the development system 400 can operate at a temperature far below the toner limitation temperature even under conditions in which the printing driving time is long, and therefore, toner coagulation can be prevented.

(Variation)

Figure 6:
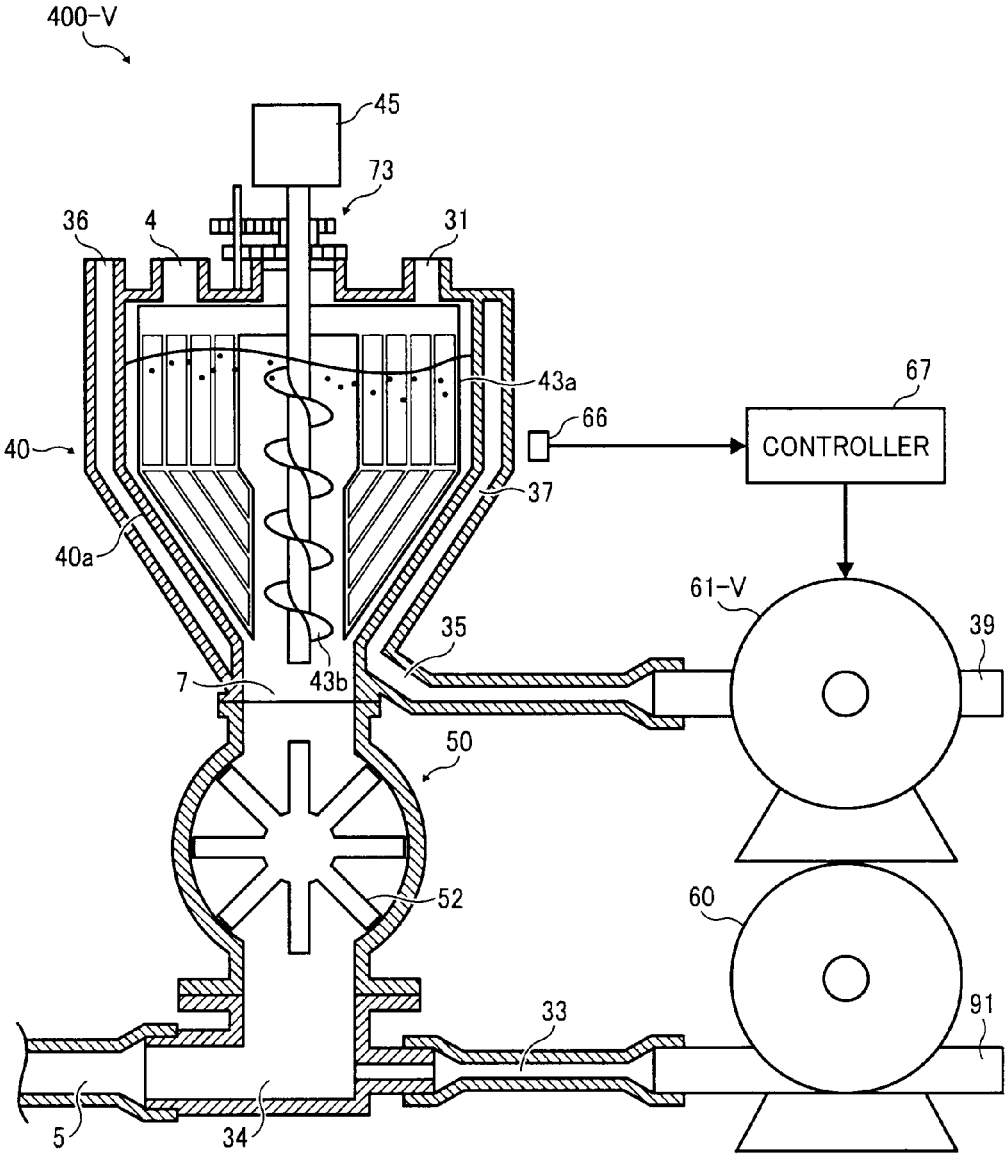
FIG. 6 is a schematic cross-sectional diagram illustrating a developer container unit and surrounding structures of a development system according to a variation of the development system shown in FIG. 4.

As a variation of the development system 400 according to the first embodiment, as shown in FIG. 6, the image forming apparatus 100 further includes a temperature detector 66 to detect temperature in the image forming apparatus 100. The image forming apparatus 100 may include a single temperature detector 66 for four development systems 400-V, or four separate temperature detectors 66 may be provided for the respective development systems 400-V. An air-refrigerating pump 61-V for supplying coolant is turned on and off based on the temperature in the image forming apparatus 100 detected by the temperature detector 66. Thus, the air-refrigerating pump 61-V is driven only when increase of temperature is great, for example, during continuous printing, by a controller 67, and therefore, excessive energy consumption can be prevented. The controller 67 may be a computer including a central processing unit (CPU) and a memory. The computer performs various types of control processing according to programs stored in the memory as functions of the controller 67.

Second Embodiment

Next, a development system 400-A according to a second embodiment is described below with reference to FIG. 7 that illustrates inner structure of a developer container unit 40-A.

In the present embodiment, the heat sink is formed of a casing (developer container 40*a*-A) and multiple ribs 38 so that the coolant receives more heat from the developer in the developer container 40*a*-A. The multiple ribs 38 are formed by multiple thin plates and protrude outward from an outer surface of the developer container 40*a*-A of the developer container unit 40-A in a radial direction of the developer container 40*a*-A.

It is to be noted that, for ease of explanation and illustration, because other than the difference described above the developer container unit 40-A has a configuration similar to the configuration of the developer container unit 40 in the first embodiment, other components of the developer container unit 40-A are represented by identical numerals and the description thereof is omitted below.

In this configuration, the coolant transported to a coolant transport path 37-A contacts a larger area of the heat sink compared with the first embodiment, which further increases the cooling efficiency.

Figure 7:
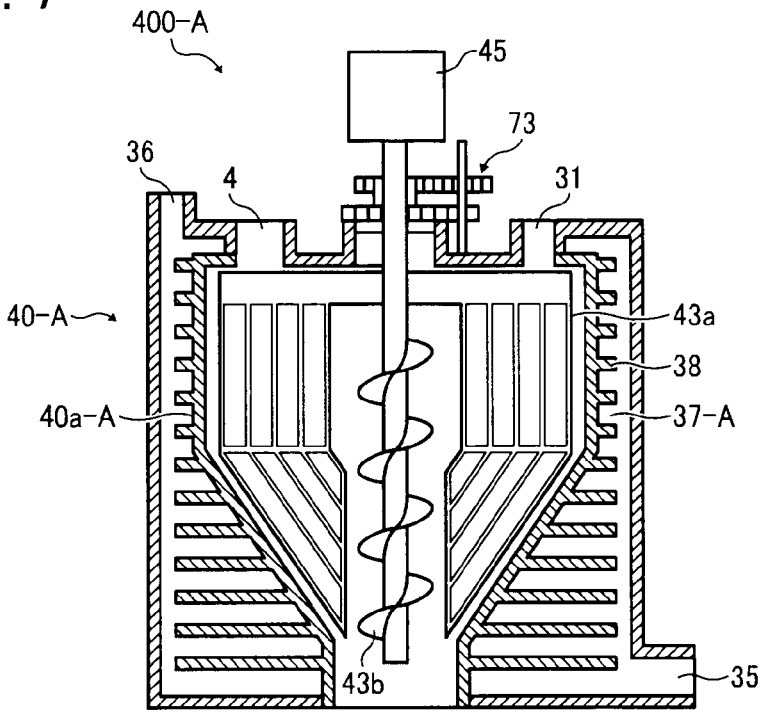
FIG. 7 is a schematic cross-sectional diagram illustrating a developer container unit and surrounding structures of a development system according to a second embodiment.

It is to be noted that, although the multiple ribs 38 are provided as additional heat sinks in the present embodiment in order to increase the contact area between the coolant and the heat sink, the additional heat sink is not limited to the multiple ribs 38 shown in FIG. 7. For example, the additional heat sink may be formed with other members having a non-planar contour, such as concavities and convexities formed in the outer surface of the developer container 40*a*-A.

Third Embodiment

Figure 8:
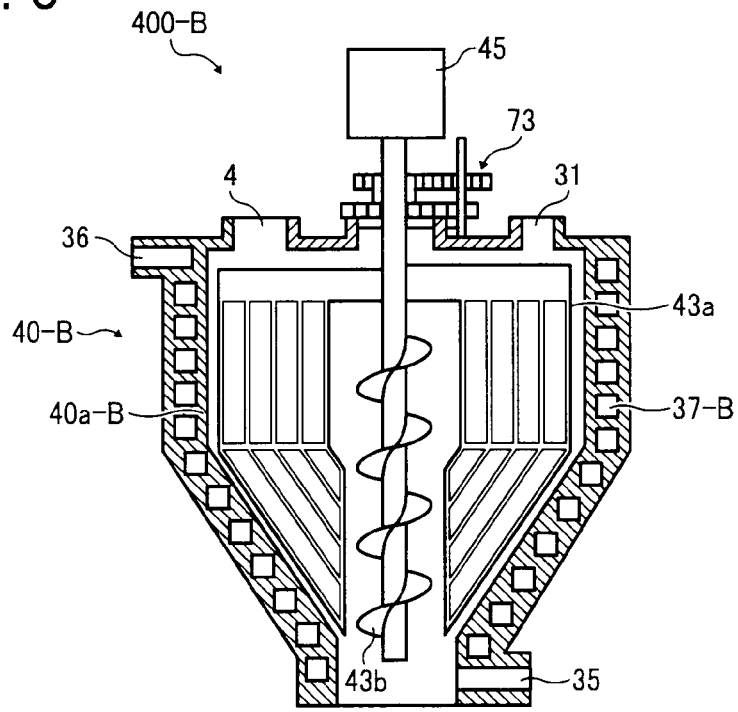
FIG. 8 is a schematic cross-sectional diagram illustrating a developer container unit and surrounding structures of a development system according to a third embodiment.

Next, a development system 400-B according to a third embodiment is described below with reference to FIG. 8 that illustrates inner structure of a developer container unit 40-B.

In the present embodiment, a coolant transport path 37-B is formed by a spiral pipe that surrounds an outer surface of a developer container 40*a*-B in the developer container unit 40-B. The coolant is transported to the single thin spiral coolant transport path 37-B through a coolant supply pipe 35-B and through the thin coolant transport path 37-B. Then, the coolant in an upper portion of the thin spiral coolant transport path 37-B is discharged outside through a coolant collection pipe 36-B. Similarly to the above-described embodiments, the heat of the developer is absorbed while the coolant passes through the coolant transport path 37-B, and the developer can be cooled in a short time.

If the coolant is dispersed unevenly, some of the coolant may be discharged without receiving the heat from the developer sufficiently, and as a result, the cooling efficiency may be decreased.

By contrast, in the present embodiment, because the coolant transport path 37-B is a single thin pipe, uneven disperse of the coolant in the coolant transport path 37-B can be prevented, and the speed of movement of the coolant can be increased. When the speed of movement of the coolant is increased, the warmed coolant is rapidly discharged outside, and the coolant whose temperature is low is rapidly supplied to the coolant transport path 37-B. Thus, the cooling efficiency can be dramatically enhanced.

(Variation)

Next, a development system 400-C according to a variation of the coolant supply member used in the above-described first through third embodiments is described below with reference to FIG. 9 that illustrates structure of a developer container unit 40-C.

In the above-described embodiments shown in FIGS. 1 through 8, a predetermined amount of the developer in the rotary feeder 50 is transported to the developer-air mixing section 34 as the rotary impeller 52 is rotated in the rotary feeder 50 by driving the impeller-driving motor 55 (see FIG.

2), and then the developer is transported to the developing section 2 through the developer-supply tube 5 by the compressed air generated from the air-refrigerating pump 61, serving as the air supply device, passing through the air supply pipe 33.

Figure 9:
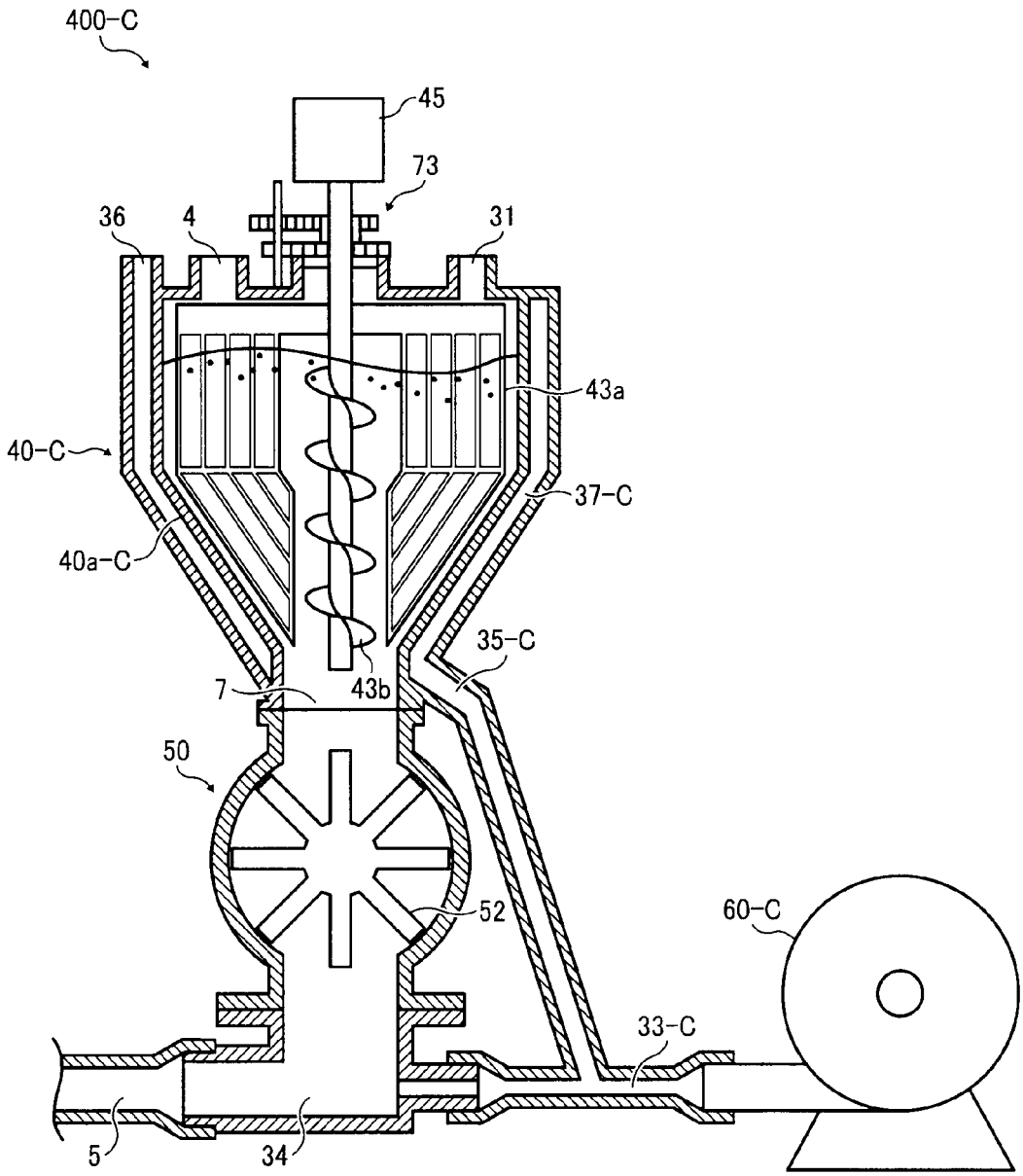
FIG. 9 is a schematic cross-sectional diagram illustrating a developer container unit and surrounding structures of a development system according to a variation of the first through third embodiments.

However, in the present variation shown in FIG. 9, a coolant transport pipe 35-C is bifurcated from an air supply pipe 33-C, and the external air in the air supply pipe 33-C supplied from an air-conveying pump 60-C is transported to a coolant transport path 37-C through the coolant supply pipe 35-C in addition to the developer-air mixing section 34 through the air supply pipe 33-C. That is, the compressed air generated from the air-conveying pump 60-C for transporting the developer can also functions as a coolant for cooling the developer. Thus, the air-refrigerating pump 61 does not need to be provided separately from the air-conveying pump 60-C, allowing the configuration of the development system 400-C to be simplified.

It should be noted that although this configuration is a variation of the development system 400 of the first embodiment, this bifurcated coolant supply pipe 35-C can also be adapted in the development system 400-A, and 400-B according to the second and third embodiments as well.

Fourth Embodiment

Figure 10:
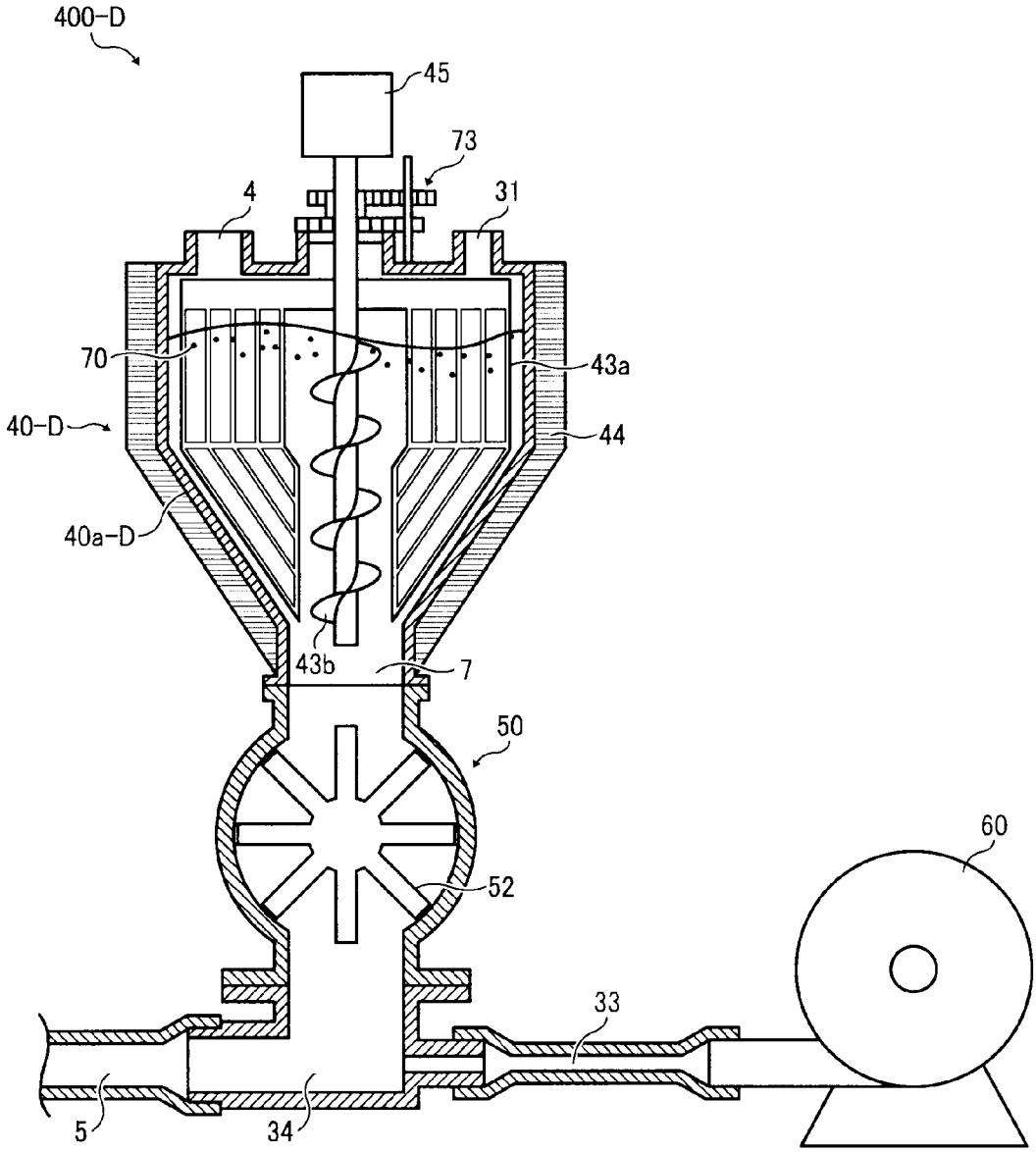
FIG. 10 is a schematic cross-sectional diagram illustrating a developer container unit and surrounding structures of a development system according to a fourth embodiment.

Next, a development system 400-D according to a fourth embodiment is described below with reference to FIG. 10 that illustrates inner structure of a developer container unit 40-D.

In the present embodiment, the developer cooler is formed of a Peltier element 44, and is provided on the outer surface of a developer container 40*a*-D of the developer container unit 40-D. Because the Peltier element 44 can transfer heat of the developer in the developer container 40*a*-D, by setting the outer side of the developer container 40*a*-D as an endothermic side, the Peltier element 44 can conduct the heat of the developer in the developer container 40*a*-D to the outside through the casing (developer container) 40*a*-D of the developer container unit 40-D.

In addition, because the agitator 43 effectively disperses and mixes the developer in the developer container 40*a*-D of the developer container unit 40-D, the developer positioned close to a center portion of the developer container 40*a*-D is rapidly moved outward, and therefore, the Peltier element 44 can uniformly cool the entire developer container unit 40-D in a short time.

Furthermore, the developer container 40*a*-D is positioned away from the developing section 2, and therefore, there is little chance that the heat released from the developer container 40*a*-D increases the temperature of the developer in the developing section 2. In addition, a fan can be provided in the development system 400-D, in which case the released heat from the developer container 40*a*-D via the developer cooler (the Peltier element 44) can be more rapidly discharged to the outside.

(Effect)

In the development system 400 (400A, 400B, 400C, and 400D) according to first to fourth embodiments, as shown in FIGS. 1 through 10, the developer that is discharged from the developing section 2 is supplied to the developer container 40*a* and conveyed through the developer-supply tube 5. Therefore, the developer whose temperature is relatively high is present in the upper portion of the developer container 40*a*, and the developer whose temperature is relatively low is present in the lower portion.

If the coolant is flown from top to bottom in the developer container unit 40, the developer positioned lower portion might be inadvertently heated by the coolant whose temperature is increased by receiving heat from the developer in the upper portion.

By contrast, in the above-described embodiments, when the coolant is supplied from bottom to top in the developer container unit 40, the coolant whose temperature is lowest in a supply initial state can cool the developer to the end. As a result, the developer that is discharged from the developer container 40*a* can be sufficiently cooled so that the temperature of the developer in the developer outlet 7 becomes nearly equal to the temperature of the coolant at the supply initial state.

Fifth Embodiment

Next, a development system 400-E according to a fifth embodiment is described below with reference to FIG. 11A.

Figure 11A:
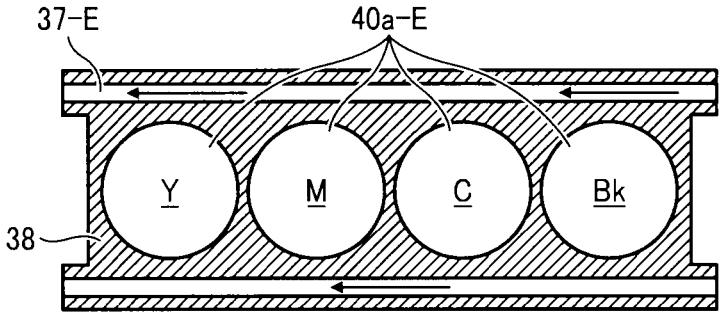
FIG. 11A is a horizontal cross-sectional diagram illustrating a casing incorporating multiple developer containers and surrounding structures of a development system according to a fifth embodiment.

FIG. 11A is a cross-section view illustrating a common casing 48 in which multiple developer containers 40*a*-E (40*a*Y, 40*a*M, 40*a*C, and 40*a*K) are housed. In this embodiment, the multiple developer containers 40*a*Y, 40*a*M, 40*a*C, and 40*a*K are integrally connected in the casing 48 in which four stations (holding spaces to hold the receptive developer containers 40*a*-E) are formed, or the multiple developer containers 40*a*Y, 40*a*M, 40*a*C, and 40*a*K are connected so as to transmit heat among the respective developer containers 40*a*Y, 40*a*M, 40*a*C, and 40*a*K. In addition, the casing 48 is formed of the heat sink, and two coolant transport paths 37-E are formed above and beneath the developer containers 40*a*-E in the casing 48. Therefore, the heat in the developer containers 40*a*Y, 40*a*M, 40*a*C, and 40*a*K is transmitted thereamong, and a uniform developer temperature in the respective stations can be maintained evenly in the casing 48.

In this embodiment, when a single color or fewer than four colors are used in the casing 48, the temperature of the station (holding space) in which the developer container 40*a*-E does not drive is not increased, and therefore, the station whose temperature is increased by driving the developer container 40*a*-E can be cooled by the station in which the developer container 40*a*-E that does not drive. In addition, the arrangement of coolant transport path 37-E can be simplified, and manufacturing cost can be reduced by sharing a single air-refrigerating pump 61 (see FIG. 2) with respective color of the developer container 40*a*-E.

Figure 11B:
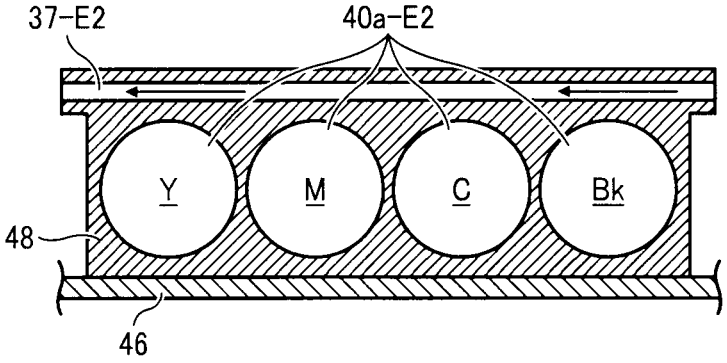
FIG. 11B is a horizontal cross-sectional diagram illustrating a casing incorporating multiple developer containers and surrounding structures of a development system according to a variation of the fifth embodiment.

FIG. 11B shows a variation of the fifth embodiment, in which developer containers 40*a*-E2 in a casing 48-E2 that is linked to an apparatus body 46 of the image forming apparatus 100. Because the apparatus body 46 is continuously exposed to external fresh air and has a large heat capacity, the heat released from the developer in the developer containers 40*a*-E2 can escape to the outside through the apparatus body 46.

In addition, by simply connecting to the developer container 40*a*-E2 to the apparatus body 46, a predetermined degree of the cool efficiency can be attained. Therefore, the manufacturing cost can be reduced using a simple configuration because the developer cooler (e.g., coolant transport path) is not required in the image forming apparatus.

Sixth Embodiment

Figure 12B:
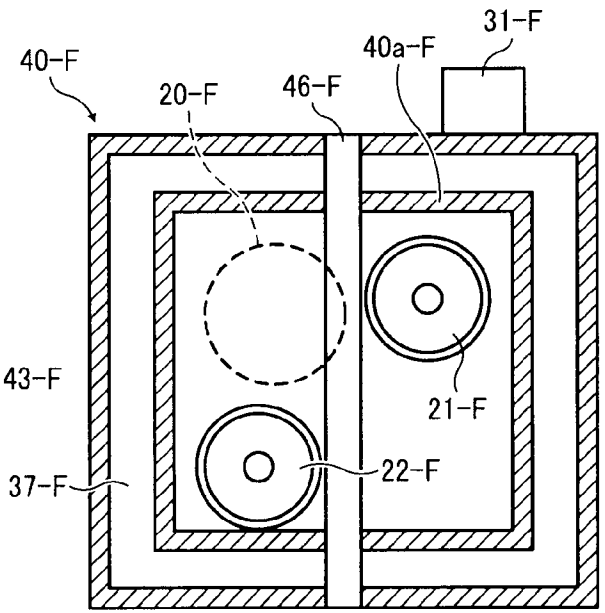
FIG. 12B is a cross-sectional diagram illustrating the developing section and surrounding structures of the development system shown in FIG. 12A.
Figure 12A:
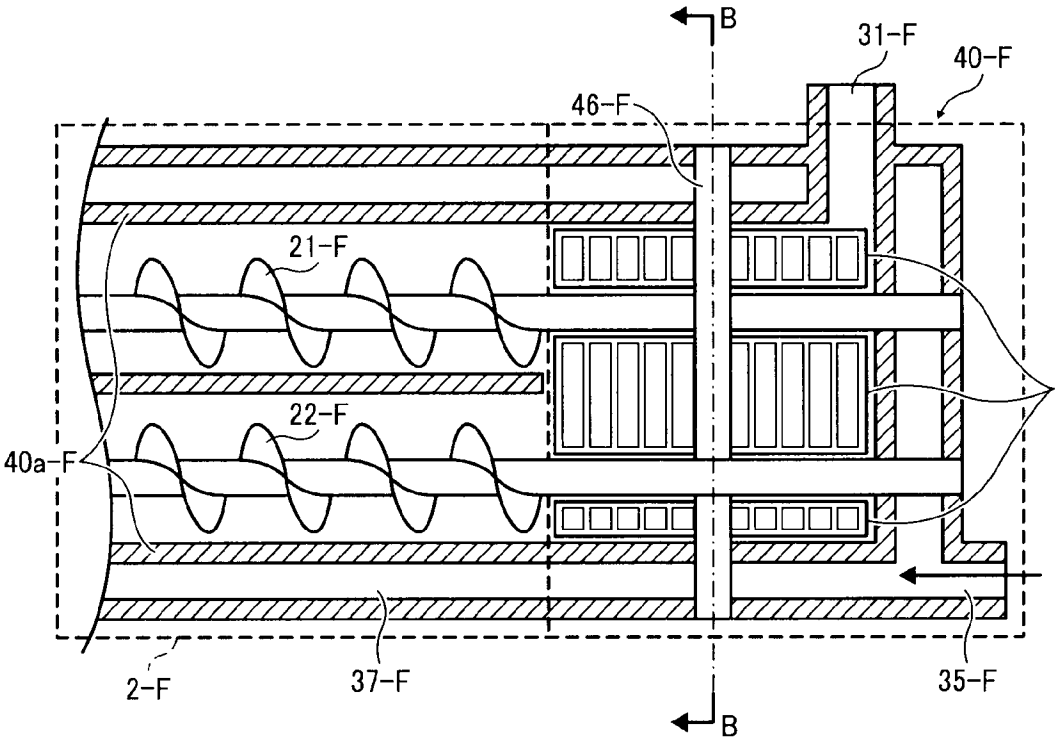
FIG. 12A is a cross-sectional diagram illustrating a developing section and a developer container and surrounding structures of a development system according to a sixth embodiment.

Next, a development system 400-F according to a sixth embodiment is described below with reference to FIGS. 12A and 12B.

In the present embodiment, a developer container 40*a*-F is provided in an end of the developing section 2-F. The developer positioned in the development section 2-F and the developer container 40*a*-F is circulated by screw conveyors 21-F and 22-F. In FIG. 12A, the developer is transported by the first screw conveyor 21-F from right to left, and some of the developer is attracted by a magnetic force generated by a development roller 20-F provided in a position indicated by a broken line in FIG. 12B. Then, the thickness of the developer on the development roller 20-F is made uniform by a doctor blade (not shown). After that, the latent image on the photoreceptor 1 is developed by contacting the toner in the developer against the development roller 20-F with the photoreceptor 1, and the toner image is formed on the photoreceptor 1.

The developer transported to the end of the first screw conveyor 21-F by the first screw conveyer 21-F (the left side in FIG. 12A) is moved to the side of the second screw conveyor 22-F through a communication path (not shown) positioned in the end. The developer thus passed through the communication path and the developer after a developing process are transported from left to right. The developer container 40*a*-F is positioned on the right shown in FIG. 12A, and the developing section 2-F is replenished with the toner via a toner inlet (toner transport path) 31-F positioned on the upper side of the first screw conveyor 21-F in the upstream side as the toner is consumed in the developing process.

In the developer container 40*a*-F, an agitator 43-F formed by multiple linear members rotates to agitate the toner and the developer so that the supplied toner is mixed with the developer. In a developer container unit 40-F, a coolant transport path 37-F surrounds the outer surface of the developer container 40*a*-F to cool the developer in the developer container 40*a*-F.

In the developer container 40*a*-F, the level difference of the developer is caused by speed difference between the developer that passes through the gap between the multiple linear members and the developer that is moved by the multiple linear members, and then, the developer is agitated and mixed with the toner uniformly in the developer container 40*a*-F.

Accordingly, cooling of the developer in the developer container 40*a*-F can be sufficiently performed. The agitated, mixed and cooled developer is passed to a chamber containing the first screw conveyor 21-F, and then is transported to the development roller 20-F again. Thus, by circulating the developer thus cooled by the coolant transport path 37-F of the developer container 40*a*-F in the development section 2-F, temperature increase in the entire development section 2-F can be alleviated, and change in the characteristics of the toner caused by an increase in temperature can be prevented.

In the first through third, fifth, and sixth embodiments, although external air is assumed as a coolant, the coolant can be a gas whose specific heat is greater than air, or a liquid, and therefore heat exchange efficiency can be enhanced between the developer and the coolant.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developing section to visualize a latent image formed on a latent image carrier with developer including toner and carrier, having a developer supply opening and a developer collection opening;

a circulation unit including:

a developer supply tube through which the developer is transported to the developer supply opening of the developing section; and a developer collection tube through which the developer is transported from the developer collection opening of the developing section;

a developer container to store the developer collected from the developing section through the developer collection tube, disposed upstream from the development section in a direction in which the developer is transported in the developer supply tube; and a developer cooler to cool the developer contained in the developer container, wherein the developer container comprises an agitator to agitator and mix the developer.

2. The development device according to claim 1, wherein the developer cooler comprises a coolant supply device and a coolant transport path, the coolant supply device supplies a coolant from outside the development device, and the coolant transport path, disposed around an outer face of the developer container, guides the coolant from the coolant supply device to the vicinity of the developer container while keeping the coolant in contact with the outer face of the developer container.

3. The development device according to claim 2, wherein the coolant transport path comprises a spiral path surrounding the outer face of the developer container.

4. The development device according to claim 1, wherein the developer cooler comprises a heat sink of high heat-conductivity material, formed in an outer face of the developer container, to transmit heat from the developer in the developer container to a coolant, and the heat sink is cooled by contacting the coolant.

5. The development device according to claim 4, wherein the heat sink of the developer cooler is formed of aluminum or copper.

6. The development device according to claim 4, wherein the heat sink has a non-planar contour to increase a contact area between the heat sink and the coolant.

7. The development device according to claim 1, wherein the developer cooler comprises a coolant transport path, disposed around an outer face of the developer container, to guide a coolant to the vicinity of the developer container while keeping the coolant in contact with the outer face of the developer container, and the coolant is external air from outside of the development device.

8. The development device according to claim 7, further comprising an air conveyance unit to cause external air coolant to convey the developer cooled in the developer container to the developer supply opening of the developing section, wherein the air conveyance unit comprises an air conveyance device to send the external air from outside the development device and a bifurcated air conveyance path to guide the air.

9. The development device according to claim 1, wherein the developer cooler transports coolant from a portion in which a temperature of the developer is low to a portion in which the temperature of the developer is high.

10. An image forming apparatus comprising:

a latent image carrier to on which a latent image is formed; and a development device to develop the latent image formed on the latent image carrier with the developer, the development device comprising:

a developing section to visualize a latent image formed on a latent image carrier with developer including toner and carrier, having a developer supply opening and a developer collection opening;

a circulation unit including:

a developer supply tube through which the developer is transported to the developer supply opening of the developing section; and a developer collection tube through which the developer is transported from the developer collection opening of the developing section;

a developer container to store the developer collected from the developing section through the developer collection tube, disposed upstream from the development section in a direction in which the developer transported in the developer supply tube; and a developer cooler to cool the developer contained in the developer container, wherein the developer container comprises an agitator to agitate and mix the developer.

11. The image forming apparatus according to claim 10 wherein the developer cooler of the development device comprises a coolant supply device and a coolant transport path, and the coolant supply device supplies a coolant from outside the development device and a coolant transport path, disposed around an outer face of the developer container, guides the coolant from the coolant supply device to the vicinity of the developer container while keeping the coolant in contact with the outer face of the developer container.

12. The image forming apparatus according to claim 11, further comprising:

a temperature detector to detect a temperature in the image forming apparatus; and a controller to turn the coolant supply device on and off based on the temperature in the image forming apparatus detected by the temperature detector.

13. The image funning apparatus according to claim 10, wherein the developer cooler comprises a heat sink of high heat-conductivity material, formed in an outer face of the developer container, to transmit heat from the developer in the developer container to a coolant, and the heat sink is cooled by contacting the coolant.

14. The image forming apparatus according to claim 10, wherein the developer cooler comprises a coolant transport path, disposed around an outer face of the developer container, to guide a coolant to the vicinity of the developer container while keeping the coolant in contact with the outer face of the developer container, and the coolant is external air from outside the image forming apparatus.

15. The image forming apparatus according to claim 14, further comprising:

an air conveyance unit to cause external air coolant to convey the developer cooled in the developer container to the developer supply opening of the developing section; and the air conveyance unit comprises an air conveyance device to send the external air from outside of the image forming apparatus and a bifurcated air conveyance path to guide the air.

16. The image forming apparatus according to claim 10, wherein the developer cooler transports the coolant from a portion in which a temperature of the developer is low to a portion in which a temperature of the developer is high.

17. The image forming apparatus according to claim 10, further comprising additional multiple developer containers to store different color developers, respectively, housed in a common casing with the developer container.

18. The image forming apparatus according to claim 10, further comprising an apparatus body of the image forming apparatus, wherein the developer container is connected with the apparatus body to transmit heat from the developer in the developer container and the apparatus body.

* * * * *